US009203182B2

(12) United States Patent
Fawcett

(10) Patent No.: US 9,203,182 B2
(45) Date of Patent: Dec. 1, 2015

(54) CONNECTOR FOR ELECTRICAL CIRCUITS

(75) Inventor: Michael John Fawcett, Lancashire (GB)

(73) Assignee: ROTA ENGINEERING LIMITED (GB)

( * ) Notice: Subject to any disclaimer, the term of this patent is extended or adjusted under 35 U.S.C. 154(b) by 28 days.

(21) Appl. No.: 14/236,101

(22) PCT Filed: Jul. 10, 2012

(86) PCT No.: PCT/GB2012/051627

§ 371 (c)(1), (2), (4) Date: Jan. 30, 2014

(87) PCT Pub. No.: WO2013/017826

PCT Pub. Date: Feb. 7, 2013

(65) Prior Publication Data

US 2014/0235088 A1 Aug. 21, 2014

(30) Foreign Application Priority Data

Aug. 3, 2011 (GB) ..... 1113338.6

(51) Int. Cl.
*H01R 13/627* (2006.01)
*H01R 13/53* (2006.01)
*H01R 13/625* (2006.01)

(52) U.S. Cl.
CPC ..... *H01R 13/627* (2013.01); *H01R 13/53* (2013.01); *H01R 13/625* (2013.01); *H01R 13/6276* (2013.01)

(58) Field of Classification Search
CPC .. H01R 13/629; H01R 13/62; H01R 2013/00; H01R 13/627; H01R 13/6277; H01R 13/6276; H01R 13/5219; H01R 13/635; G01R 1/067
USPC ..... 439/349, 348, 258, 248
See application file for complete search history.

(56) References Cited

U.S. PATENT DOCUMENTS 2,411,861 A 12/1946 Antony, Jr. et al.
3,165,340 A * 1/1965 Kuehl et al. ..... 285/316

(Continued)

FOREIGN PATENT DOCUMENTS

DE 29900847 U1 1/1999
EP 1081799 A1 4/2003

OTHER PUBLICATIONS

International Search Report of the International Searching Authority for Application No. PCT/GB2012/051627; Date of Mailing Oct. 19, 2012.

(Continued)

*Primary Examiner* — Abdullah Riyami
*Assistant Examiner* — Vladimir Imas
(74) *Attorney, Agent, or Firm* — Cantor Colburn LLP

(57) ABSTRACT

A connector for interconnecting or mutually isolating two or more electrical circuits is provided. The connector comprises first and second inter-engageable connector parts. A first part comprises a spigot and first contact pins for connection to an electrical circuit. The second connector part comprises a socket and second contact pins for connection to an electrical circuit. The second part has a lock ball projecting into the socket. The first part defines a groove for receipt of the lock ball. The first contact holder has a first shroud disposed around the first contact pins. The first shroud extends beyond the first contact pins. The second contact holder has second shrouds disposed around the each second contact pin. The second shrouds extends beyond the second contact pins. The contact holders are arranged such that when the spigot is received in the socket, the connector parts are moveable between a first position and a second position.

13 Claims, 6 Drawing Sheets

(56) References Cited

U.S. PATENT DOCUMENTS

| | | | | | |
|---|---|---|---|---|---|
| 3,319,213 | A | * | 5/1967 | Roland | 439/348 |
| 3,422,390 | A | * | 1/1969 | Tucker | 439/348 |
| 3,517,371 | A | * | 6/1970 | Buckley | 439/321 |
| 3,888,559 | A | | 6/1975 | Geib | |
| 3,932,933 | A | | 1/1976 | Broad | |
| 5,129,837 | A | * | 7/1992 | Williams | 439/348 |
| 5,217,391 | A | * | 6/1993 | Fisher, Jr. | 439/578 |
| 5,329,262 | A | * | 7/1994 | Fisher, Jr. | 333/33 |
| 5,458,496 | A | * | 10/1995 | Itou et al. | 439/34 |
| 5,486,120 | A | * | 1/1996 | McMills et al. | 439/521 |
| 5,516,303 | A | * | 5/1996 | Yohn et al. | 439/248 |
| 5,637,010 | A | * | 6/1997 | Jost et al. | 439/352 |
| 5,662,500 | A | | 9/1997 | Yeah | |
| 5,702,264 | A | * | 12/1997 | Endo et al. | 439/346 |
| 5,743,754 | A | * | 4/1998 | Cristich | 439/349 |
| 5,746,619 | A | * | 5/1998 | Harting et al. | 439/352 |
| 5,800,197 | A | * | 9/1998 | Hyzin | 439/372 |
| 6,305,947 | B1 | * | 10/2001 | Bruce | 439/63 |
| 6,439,925 | B1 | * | 8/2002 | Lin et al. | 439/578 |
| 6,663,397 | B1 | * | 12/2003 | Lin et al. | 439/63 |
| 6,692,286 | B1 | * | 2/2004 | De Cet | 439/352 |
| 6,749,454 | B2 | * | 6/2004 | Schmidt et al. | 439/350 |
| 6,773,278 | B2 | * | 8/2004 | Valasek et al. | 439/157 |
| 6,773,292 | B2 | * | 8/2004 | Fawcett | 439/348 |
| 6,893,284 | B1 | * | 5/2005 | Fawcett et al. | 439/348 |
| 7,128,604 | B2 | * | 10/2006 | Hall | 439/578 |
| 7,137,825 | B2 | * | 11/2006 | Myer et al. | 439/63 |
| 7,207,824 | B1 | * | 4/2007 | Schumacher et al. | 439/352 |
| 7,275,949 | B1 | * | 10/2007 | Speaker, IV | 439/271 |
| 7,422,463 | B2 | * | 9/2008 | Kuo | 439/349 |
| 7,530,842 | B1 | * | 5/2009 | Hsu | 439/578 |
| 7,575,459 | B2 | * | 8/2009 | Nickol | 439/314 |
| 7,670,060 | B2 | * | 3/2010 | Ziemke et al. | 385/55 |
| 7,892,004 | B2 | * | 2/2011 | Hertzler et al. | 439/312 |
| 7,896,655 | B1 | * | 3/2011 | Blasick et al. | 439/63 |
| 8,272,886 | B2 | * | 9/2012 | Seido | 439/352 |
| 8,632,353 | B2 | * | 1/2014 | Rassoolkhani et al. | 439/358 |
| 8,764,473 | B2 | * | 7/2014 | Komatsubara | 439/348 |
| 8,771,002 | B2 | * | 7/2014 | Chiu et al. | 439/348 |
| 8,858,252 | B2 | * | 10/2014 | Ijima | 439/348 |
| 2010/0015850 | A1 | * | 1/2010 | Stein | 439/581 |
| 2014/0235088 | A1 | * | 8/2014 | Fawcett | 439/349 |

OTHER PUBLICATIONS

UK Search Report for GB Application No. 1113338.6 dated Dec. 9, 2011; Mailed Dec. 14, 2011; 3 pages.

* cited by examiner

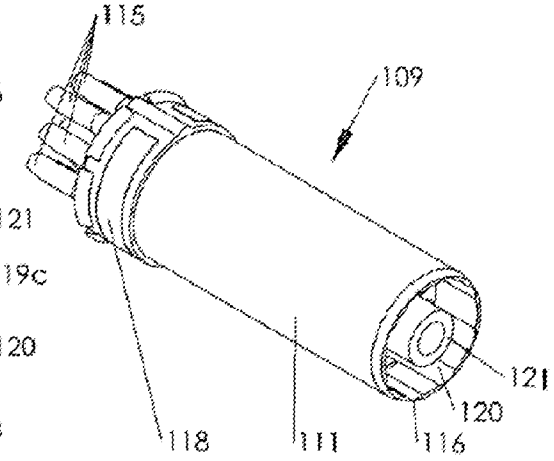
FIG. 16
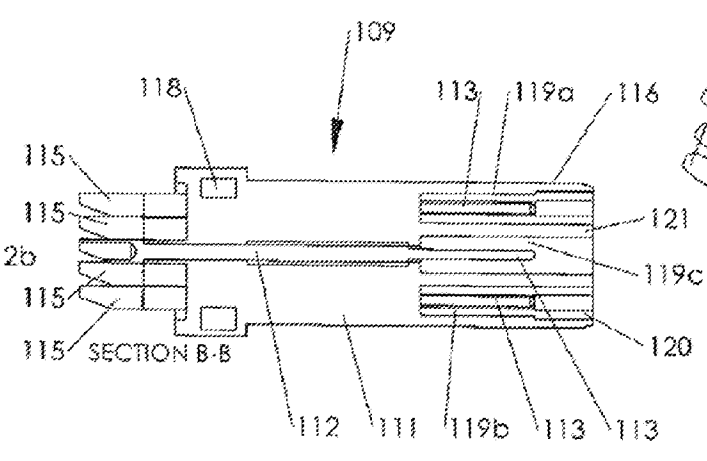
FIG. 18
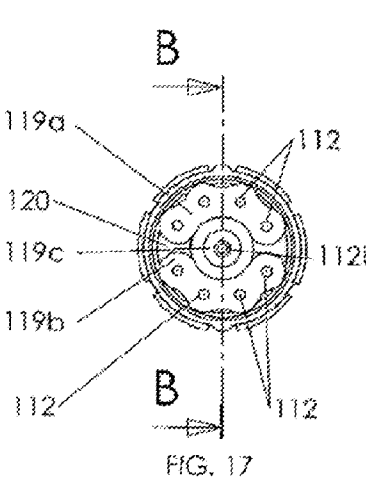
FIG. 17
FIG. 20
FIG. 21
FIG. 19

CONNECTOR FOR ELECTRICAL CIRCUITS

BACKGROUND OF THE INVENTION

The present invention relates to a connector for interconnecting or mutually isolating two or more electrical circuits. There is a requirement for electrical connectors that can be used safely in applications where they may be exposed to explosive atmospheres. Such applications are found in industrial plants, for example, in the oil, gas, petrochemical and mining industries. The explosive atmosphere may be due to the presence of explosive gas, liquid, vapour, or combustible powder or dust (e.g. grain dust, mineral dust or powder etc.).

Industrial plants are categorised into zones according to the likelihood of explosive gases being present. Various protection measures are adopted to prevent explosion and the International Electromechanical Commission (IEC) has established standards relating to equipment for use in explosive atmospheres such as, for example, IEC 60079. Connectors in accordance with the standard should be capable of being used in an explosive atmosphere such that if two interengageable connector elements of the connector are separated and a spark is generated, any resulting explosion is contained within the connector structure and is prevented from being transmitted to the surrounding environment.

The IEC 60079 standard stipulates that plug and socket connectors should be interlocked mechanically so that they cannot be separated when the contacts are energised (i.e. when power is still being supplied to the connector elements). Alternatively the connector elements may be secured together by means of special fasteners and marked with a warning such as "do not separate when energised".

The IEC 60079-0 standard provides for less rigorous criteria in relation to connectors that are rated for currents not exceeding 10 A and voltages not exceeding 254V a.c. or 60 V d.c. This standard requires that plugs and sockets are separated with a time delay such that the rated current flow ceases and any arc is extinguished prior to separation. The plug and socket should remain flameproof to IEC 60079-1 during the arc quenching period. Plugs remaining energised when not engaged with a socket outlet are not permitted.

BRIEF SUMMARY OF THE INVENTION

It is an object of particular embodiments of the present invention to provide for a connector that can meet the stringent safety requirements even if both parts remain connected to a source of electrical energy after separation. According to the present invention there is provided a connector for interconnecting or mutually isolating two or more electrical circuits, comprising first and second inter-engageable connector parts, the first part comprising a spigot extending along an axis and at least one first contact for connection to a respective electrical circuit, the second connector part comprising a socket into which the spigot is to be inserted and at least one second contact for connection to a respective electrical circuit, the second part supporting at least one member projecting radially into the socket, the first part defining at least one groove for receipt of the member, a first contact holder of electrically insulating material carrying the at least one first contact and a second contact holder of electrically insulating material carrying the at least one second contact, wherein the first contact holder has a first shroud disposed around the at least one first contact, the first shroud extending axially beyond the at least one first contact, and the second contact holder has a second shroud disposed around the at least one second contact, the second shroud extending axially beyond the at least one second contact, the contact holders being arranged such that when the spigot is received in the socket, the connector parts are moveable between a first axial position in which one of the first and second shrouds is received within the other of the first and second shrouds but the first and second contacts are axially separated and a second axial position in which one of the first and second shrouds is received within the other and the first and second contacts are engaged.

The provision of first and second shrouds as part of the electrically insulating first and second contact holders ensures the contacts are protected from inadvertent contact with a user. This allows the contacts to remain live after separation. The shrouds are such that the electrical contacts cannot be reached by a human finger.

When separating the two connector halves they are moved from the second axial position to the first axial position before they are separated. In the first axial position the contacts are disengaged but any arc or spark is contained within the first and second parts which are still engaged. The connector parts may be rotatable about the axis at the first position. This provides a delay in the separation of the first and second connector parts as they are pulled (or blown apart). Such a delay may allow any arc or spark to be extinguished prior to the complete separation of the two connector parts. There may be provided a clearance between the first and second shrouds in the first axial position to allow for relative rotation of the connector parts about the axis.

The first and second contact holders may be separate bodies that are insertable (preferably removably insertable) into outer bodies of the first and second connector parts. They are preferably wholly received within the outer bodies.

One of the first and second shrouds may be in the form of a male shroud spigot that is receivable within a female recess defined by the other of the first and second shrouds. Thus there may be mechanical engagement of the first and second contact holders but no engagement of the first and second electrical contacts such that the electrical circuits are not connected.

The first shroud may define the female recess and may be substantially annular. The second shroud may define the male shroud spigot. The at least one first contact may be a male contact and the at least one second contact may be a female contact, the at least one male contact being received in the at least one female contact when the connectors are in the second axial position. The male and female contacts may be defined by contact pins and may be defined on the ends of the contact pins. A first part of the female recess may be a channel in which at least a leading end of the male shroud spigot is received when the connector parts are in the first axial position. The channel may at least partially circumscribe the axis so as to accommodate relative rotation of the connector parts about the axis. The channel may be approximately or substantially annular or partially annular. It may comprise substantially circular openings interconnected by arcuate passages. Alternatively it may comprise multiple channel portions. The first contact does not, preferably, extend into the channel.

A second part of the female recess may comprise a bore or socket for receipt of the male shroud spigot. The first contact has an end for engagement with an end of the second contact and preferably the end is wholly received within the bore or socket. The first part of the female recess is disposed at a mating end of the first shroud and the second part of the female recess is axially offset from the mating end. In the second axial position the shroud spigot may be received in the respective bore or socket defined by the female recess.

The first shroud may have a central boss that is radially inboard of the channel in the female recess. The male shroud spigot may have at least one recess on its outer surface to accommodate its receipt in the channel. The at least one recess may provide clearance between the male shroud spigot and edges of the channel so as to permit relative rotation of the first and second connector parts.

The male shroud spigot may extend from a main body of one of the first and second contact holder. There may be a plurality of first contacts within the first shroud. There may be a plurality of second contacts each with its own second shroud. At least some of the second shrouds may be joined together around two or more second contacts.

The spigot of the first connector part may define at least one groove and the socket of the second connector part may support at least one member for projecting into the socket. The groove may extend from location at or near a free end of the spigot. The groove may be configured to receive the at least one member. At least a first portion of the groove may extend in a direction that is transverse (which may or may not be perpendicular) to the axis of the spigot. A second portion of the groove may extend in an axial direction towards or away from the end of the spigot. The at least one member may be any suitable member for travel along the groove. It may be in the form of a ball that extends into the socket. The groove may comprise at least two portions that extend in an axial direction, those two portions being interconnected by the transverse portion and being angularly offset from one another.

BRIEF DESCRIPTION OF THE DRAWING

The at least one member and the groove are designed to guide the connector parts between the first and second axial positions and to guide the connector parts in rotation between the first and second axial positions. Specific embodiments of the present invention will now be described, by way of example only, with reference to the accompanying drawings in which:

FIG. 16 is a perspective view of a male contact holder in accordance with a second embodiment of the present invention;

FIG. 17 is an end view of the male contact holder of FIG. 16;

FIG. 18 is a sectioned side view of the male contact holder along line B-B of FIG. 17;

FIG. 19 is a perspective view of a female contact holder in accordance with a second embodiment of the present invention;

FIG. 20 is an end view of the female contact holder of FIG. 19; and

FIG. 21 is a sectioned side view along line A-A of FIG. 20.

DETAILED DESCRIPTION OF THE INVENTION

Figure 1:
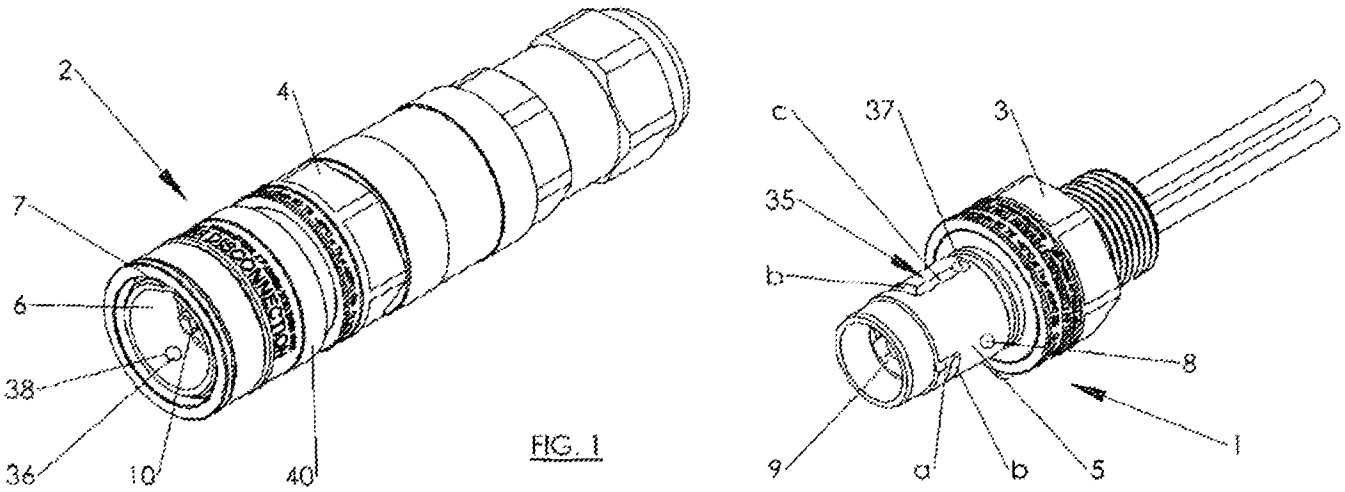
FIG. 1 is a perspective view of first and second halves of a first embodiment of a connector in accordance with the present invention.

Referring now to FIG. 1 of the drawings, a first embodiment of the connector has first and second connector halves 1, 2 for selective connection and disconnection. Each connector half 1, 2 is connected to a respective electrical circuit via wires. The first half 1 has a generally cylindrical outer body 3 in which a male contact holder 9 is housed. The second half 2 of the connector also has a generally cylindrical outer body 4 in which a female contact holder 10 is housed. When the two connector halves 1, 2 are connected the male and female contacts of the two holders 9, 10 are inter-engaged so as to complete the electrical circuit.

The outer body 3 of the first half 1 of the connector defines a cylindrical spigot 5 for insertion into a cylindrical socket 6 defined by the outer body 4 of the second half 2 of the connector. The spigot and socket 5, 6 extend along a common axis when aligned for connection and the outer diameter of the cylindrical spigot 5 of the first half 1 is slightly smaller than the inner diameter of the socket 6 of the second half 2 so that they may be concentrically disposed when connected together.

To facilitate appropriate rotational alignment, the second connector half 2 includes an alignment mark (groove) 7 for alignment with a corresponding alignment mark (dimple) 8 on the first connector half 1 prior to inter-engagement of the connector halves.

Referring now to FIGS. 2 to 7, each contact holder 9, 10 is in the form of an insert assembly that includes an electrically insulating, generally cylindrical body 11 supporting electrical contacts in the form of electrically conductive contact pins 12. Each contact holder 9, 10 is designed to be wholly received within the outer body 3, 4 of the respective connector half 1, 2. In this particular embodiment there are three equiangularly spaced contact pins 12. The male contact holder 9 supports contact pins 12 with male ends 13 that are designed to engage with corresponding female ends 14 of contact pins 12 supported in the female contact holder 10. The male and female ends 13, 14 of the contact pins 12 are each shrouded by the insulating body 11, whereas the other ends 15 of the pins 12 project out of the body where they are, in use, connected to respective electrical or electronic circuits via wires. The ends 15 are recessed to facilitate the coupling of the wires to the pins 12 via soldering. The male contact holder body 11 (which supports the contact pins 12 with the male ends 13) has a generally cylindrical outer surface with a substantially constant diameter along most of its length. A first end of the body 11 extends axially beyond the male ends 13 of the contact pins 12 so as provide a protective shroud 16 that prevents inadvertent contact between the pins 12 and the user. At the opposite, second end of the body, a short section 17 surrounding an earthing plate 18 has a slightly larger diameter. The male end 13 of each pin 12 is received in a corresponding coaxial bore 19 that extends from the first end of the body and forms part of the shroud. The diameter of each bore 19 is greater than that of the corresponding pin 12 so as to provide an annular clearance between the body 11 and the pin 12. In a first part of the protective shroud 16, which extends between the first end of the body and the tips of the pin ends 13, the bores 19 are interconnected by arcuate passages so as to form a continuous channel 20 with an approximately annular profile. The channel 20 is defined around a boss 21 disposed on the central axis of the contact holder 9 and within the protective shroud 16. The channel 20 extends to a depth that is just short of the ends 13 of the pins 12.

The female contact holder 10 (which supports the contact pins 12 with the female ends 14) has a body 11 with a cylindrical portion 11 *a* from which three cylindrical spigots 25 extend in the axial direction. The cylindrical portion 11 *a* is similar to that of the male contact holder 9 but is significantly shorter. The spigots 25 serve as shrouds that conceal the three female ends 14 of the contact pins 12. Each shroud spigot 25 extends beyond the tip of the corresponding pin 12 so as to prevent inadvertent contact with a user. A first shroud spigot 25, which surrounds the earth pin 12*a*, extends beyond the tip by a first distance and the other two shroud spigots 25 extend beyond the other two pin tips by a second, slightly longer, distance.

When the two halves 1, 2 of the connector are fully engaged such that the respective pins 12 are in electrical contact, the male and female contact holders 9, 10 are mechanically inter-engaged. More specifically, when the male pin ends 13 are received in the female pin ends 14 in electrical contact, the three shroud spigots 25 are received in the clearances defined by the bores 19 between the holder 9 and the male pin ends 13.

In order to accommodate limited relative rotational movement between the connector halves 1, 2 when they are partially engaged, the exterior surface of each end of the shroud spigots 25 is reduced in dimension by arcuate recesses 26, 27. First arcuate recesses 26 are defined on the surfaces at a first radial distance from the central axis of the female contact holder 10 and second arcuate recesses 27 are defined on the surfaces at a second, shorter, radial distance from the central axis. The first recesses 26 leave the surface of the shroud spigots 25 with a slight convex curvature and the second recesses 27 leave a concave surface. The recesses 26, 27 are designed such that the ends of the shroud spigots 25 are able to rotate about the central axis by a limited amount within the channel 20 defined in the first end of the male contact holder 9.

Each contact holder 9, 10 includes an earthing plate 18 that provides the earth connection between the earth pin 12*a* and the outer metal casing 3, 4 of the connector. The earthing plate 18 is formed of an electrically conductive material. Preferably, the earthing plate is formed as a single disc-shaped element, and is arranged to provide a direct connection between the earth pin 12*a* and the conductive outer casing 3, 4.

The earthing plate 18 has an aperture 30 arranged to receive the earthing pin 12*a* via a push fit connection. The earthing plate 18 has two further larger apertures (not shown in the figures) sized to allow the other pins 12 to pass through the apertures so that no electrical contact is made. A clearance between each of the non-earth contact pins and the larger apertures is filled with insulating material of the contact holder body 11. The outer surface of the earthing plate 18 is generally circular, apart from a short planar portion. The electrically insulating body 11 of each contact holder 9, 10 may be moulded around the respective contact pins 12 and the earthing plate 18 during manufacture.

The relative linear and rotation movement of the connector halves 1, 2 during engagement and disengagement is limited by a groove and locking ball arrangement, which is shown most clearly in FIG. 1. The first connector half 1 has a groove 35 defined in the outer surface of the spigot 5 for receiving a ball 36 of the second connector half 2. The groove 35 is non-linear and in this particular embodiment comprises three portions a,b,c. Groove portion b extends transverse the spigot axis. Here, the groove portion extends in a plane generally perpendicular to the spigot axis. However, it should be understood that the term transverse simply indicates that the groove portion extends at an angle to the axis (i.e. in a plane that crosses the axis, rather than extending parallel to the axis). Groove portions, a and c, extend axially (i.e. in a direction substantially parallel to the axis) but are axially and angularly offset in such a manner that they are interconnected by groove portion b. The groove is of non-uniform depth. The groove portion, c, which is nearest furthest from the free end of the spigot 5 terminates in a ball (or locking member) seat 37 which is slightly deeper than the rest of the groove 35.

The second connector half 2 supports a locking member in the form of a ball 36. The locking ball 36 is located within an aperture 38 opening into the socket 6. The aperture 38 is shaped to prevent removal of the ball 36 from the socket 6 in a radially inwards direction. The ball 36 can be in two positions—a first position in which the ball projects a first, relatively small, distance into the socket 6 for engaging the relatively shallow section of the groove 35, and a second position in which the ball 36 projects a larger distance into the socket 6 for engagement in the ball seat 37. The ball and groove arrangement is described in more detail in our international patent application WO2007/071968.

The second half 2 of the connector has a retractable spring-loaded collar 40 that is supported on the outer body 4 of the second part 2 and has two positions: a first, retracted position and a second, engaged position. In the second, engaged position a radially inwardly projecting rib 41 of the collar 40 displaces the ball in the radially inwards direction, and causes the ball 36 to project by the second, relatively large distance into the socket 6. The collar 40 is resiliency biased to be in the engaged position i.e. the collar is resiliency biased by a biasing means providing force extending in direction indicated by arrow in FIG. 15. In the embodiment illustrated the collar 40 is resiliency biased by a coil spring 42. On retraction of the collar, the inwardly projecting rib 41 is axially displaced, such that the rib is not radially aligned with the ball 36, thereby allowing the ball to move in a radially outwards direction. This allows the ball 36 to be pushed back into the aperture 38, so that the ball 36 extends the first, relatively small distance into the socket 6.

Figure 9:
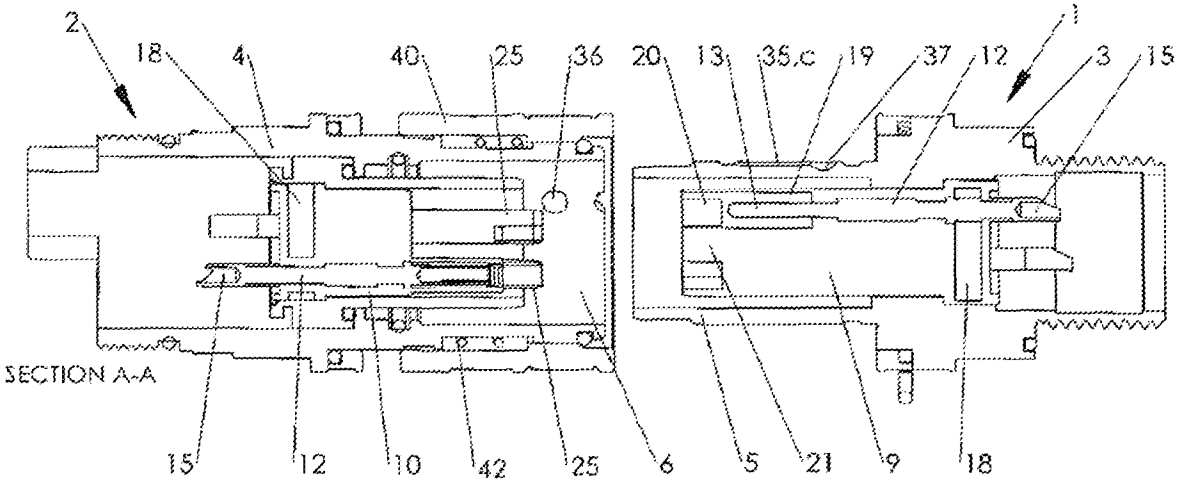
FIGS. 9 to 11 are part-sectioned views along the line A-A of FIG. 8, illustrating successive stages in the axial interconnection of the connector halves.

The mechanical inter-engagement and electrical connection of the two connector halves 1, 2 will now be described with reference to FIGS. 8 to 15. The halves 1, 2 are presented to one another such that their central longitudinal axes are coaxially aligned and the alignment marks 7, 8 are aligned as shown in FIG. 9. In this position the collar 40 is extended by the spring 42.

Figure 10:
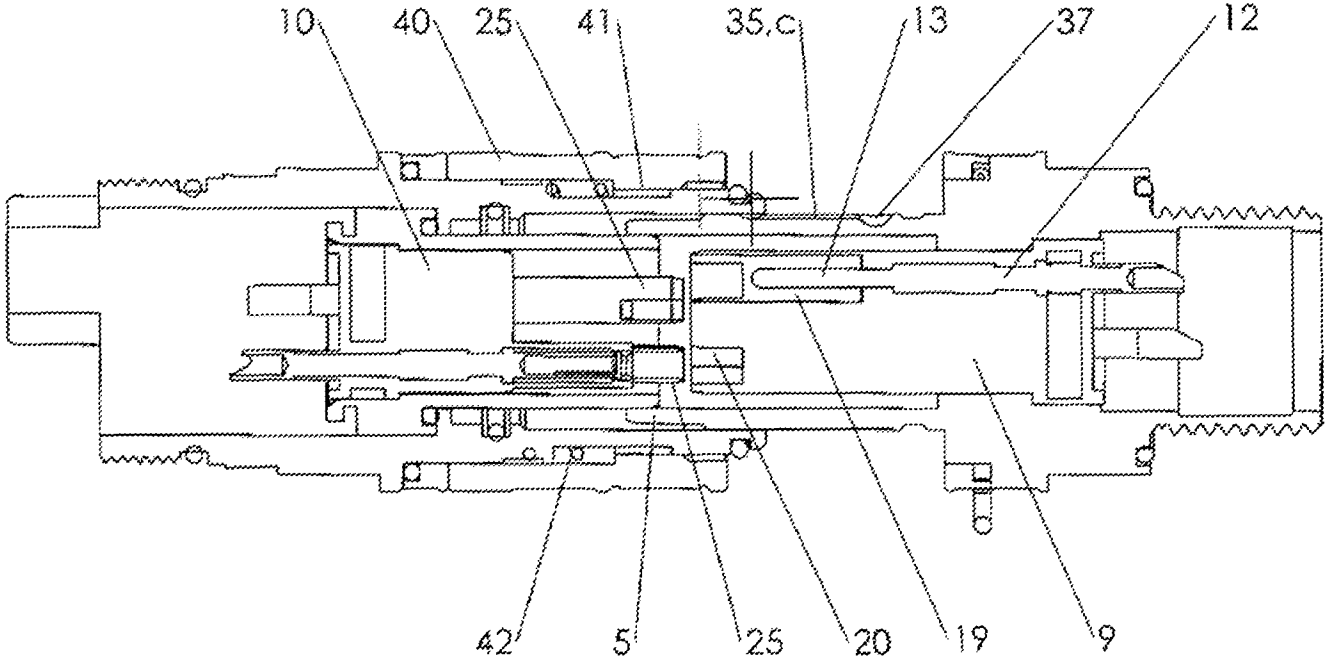

Referring now to FIG. 10, in order to interconnect the connector halves the collar 40 is retracted against the spring force such that the ball 36 is free to be displaced radially (the ball 36 is hidden from view in FIG. 10). The two halves of the connector 1, 2 are then pushed together such that spigot 5 enters the socket 6 and further axial movement in the same direction pushes the ball 36 radially outwards. When the alignment marks 7, 8 are in alignment the lock ball 36 will enter and travel along the first portion, a, of the groove. If the alignment marks 7, 8 are not in alignment the spigot 5 will not be able to move very far into the socket 6.

Figure 11:
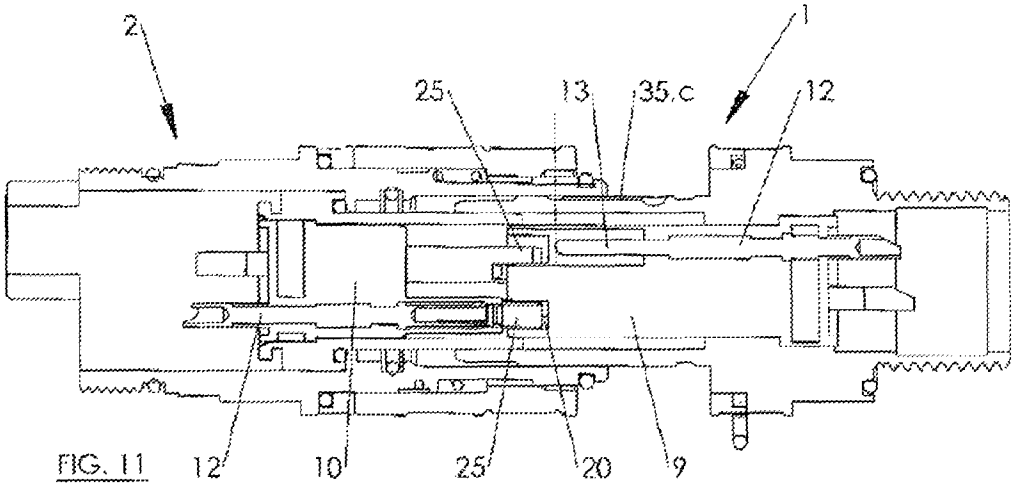

When the axial movement is such that the ball 36 reaches the end of the first portion, a, of the groove 35, the shroud spigots 25 of the female contact holder 10 occupy the annular channel 20 of the male contact holder 9 such that they are misaligned with the bores 19 by 60°, as shown in FIG. 11. However, the respective contact pins 12 remain axially separated.

Figure 8:
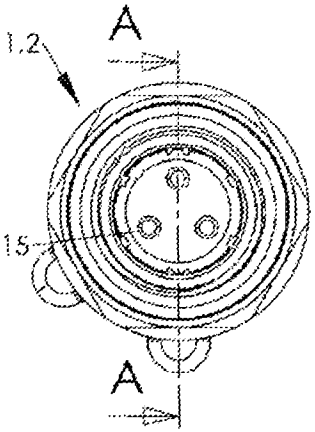
FIG. 8 is a rear end view of the first and second halves of the connectors in axial alignment.
Figure 2:
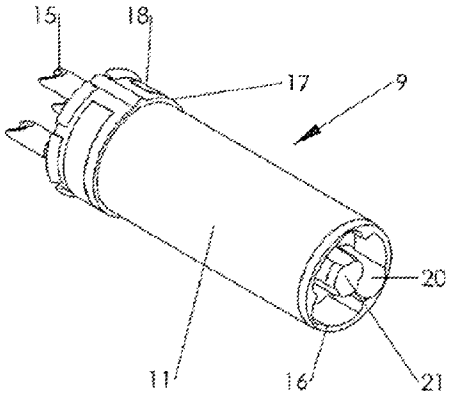
FIG. 2 is a perspective view of a male contact holder of FIG. 1.
Figure 4:
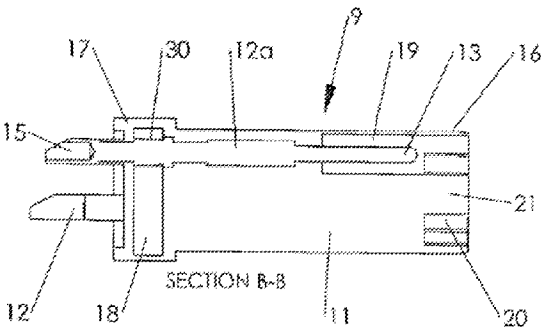
FIG. 4 is a sectioned side view of the male contact holder of FIG. 3 along line B-B.
Figure 3:
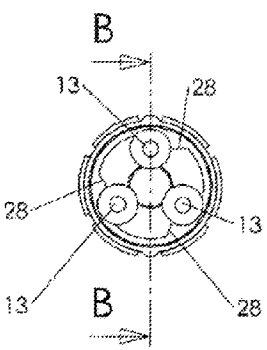
FIG. 3 is an end view of the male contact holder of FIG. 2.
Figure 7:
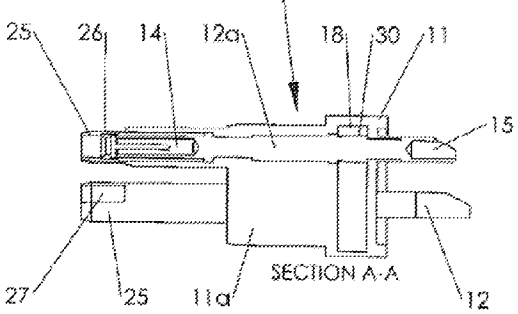
FIG. 7 is a sectioned side view of the female contact holder of FIG. 6, along line A-A.
Figure 5:
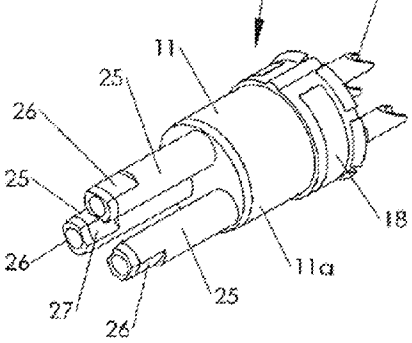
FIG. 5 is a perspective view of a female contact holder of the connector of FIG. 1.
Figure 6:
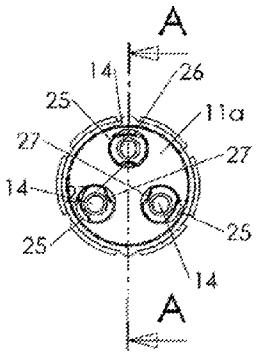
FIG. 6 is an end view of the female contact holder of FIG. 5.
Figure 13:
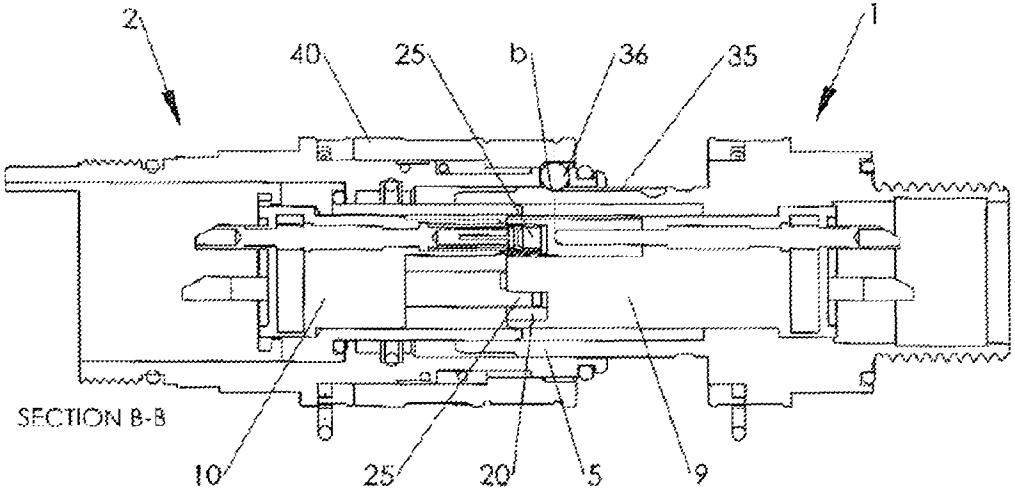
FIGS. 13 to 15 are part-sectioned views along line B-B of FIG. 12, illustrating further successive stages in the axial interconnection of the connector halves.
Figure 12:
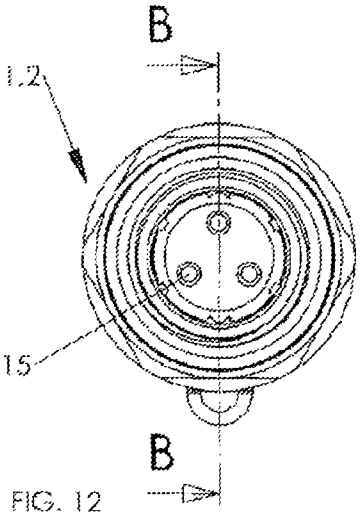
FIG. 12 is a view corresponding to that of FIG. 8 but with the connector halves rotated relative to each other.
Figure 14:
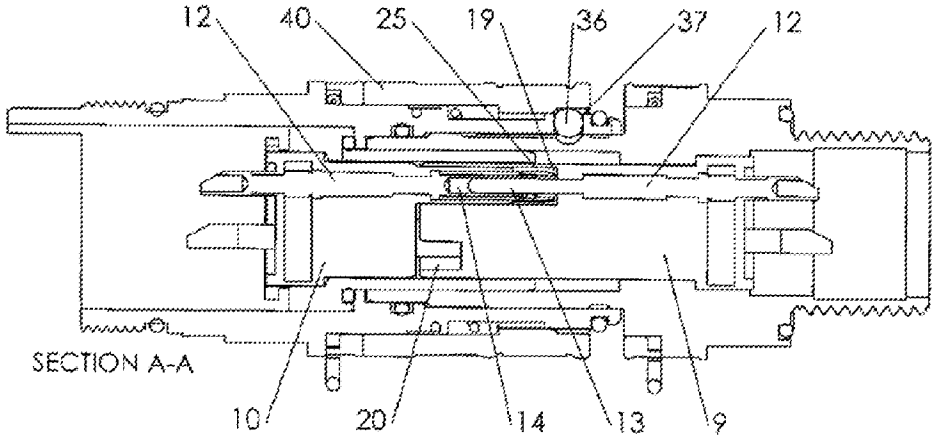

The connector halves 1, 2 are then rotated relative to each other so as to move the ball 36 along the traverse portion b of the groove 35 to the start of the axial portion c. This is shown in FIGS. 12 and 13. A comparison of the end views of FIGS. 8 and 12 illustrate that the rotation in this particular embodiment is through 60°. During this movement the shroud spigots 25 move around the annular channel 20 and partially circumscribe the central boss 21. This results in the male shroud spigots 25 being aligned with the bores 19 and the contact pins 12 being suitably aligned for electrical contact. In FIGS. 12 and 13 the connector half 2 containing the female contact holder 10 has been rotated relative to the connector half 1 whose position is stationary as compared to the positions shown in FIGS. 8 and 11. This brings the ball 36 into view in FIG. 13.

Subsequent pushing of the connector halves 1, 2 together moves the ball 36 along the final portion, c, of the groove 35. At the same time the shroud spigots 25 travel further into the bores 19 so that the respective pins 12 move axially towards one another. At the end of the length of travel of the ball along the final portion, c, of the groove 35 the male pin ends 13 are received in the female pin ends 14. In this position, shown in FIG. 14, the male pin ends 13 are fully mated with the female pin ends 14 such that electrical contact is made. In addition, the lock ball 36 is engaged with the ball seat 37.

Figure 15:
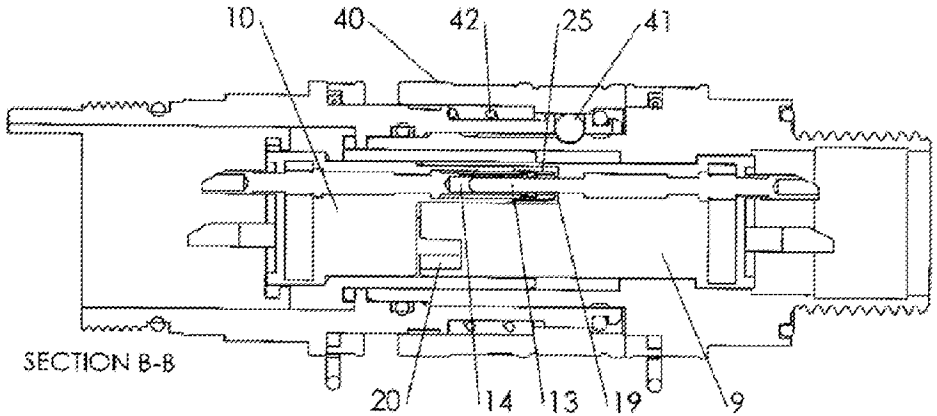

In FIG. 15 the collar 40 is released so that it is resiliency biased to the engaged position, whereupon the rib 41 pushes the lock ball 36 radially inwards into the corresponding ball seat 37. The lock ball 36 once again has no radial freedom of movement, thus locking the two connector halves 1, 2 together. It is thus not possible to separate the two connector halves 1, 2 without first retracting the collar 40. Disengagement of the two connector halves 1, 2 happens in the reverse sequence to their connection. First, the collar 40 is retracted so as to permit the lock ball 36 radial freedom of movement. The halves 1, 2 are then pulled in a direction away from each other. This results in partial separation as the ball travels 36 along the final groove portion c. This results only in partial disengagement of the connector halves 1, 2. In particular the contact pins 12 are disengaged such that they are axially separated and electrical connection is broken. However, the two halves 1, 2 of the connector are not separated as the spigot 5 of the first half is still received in the socket 6 of the second half and the contact holders 9, 10 are not separated as the shroud spigots 25 still occupy the annular channel 20.

In order to allow full disengagement, the connector halves 1, 2 are rotated relative to one another so that the lock ball 36 travels along the transverse groove portion b. Such a rotation provides a delay in the release of the connector halves 1, 2. It will be noted that the electrical contacts are fully enclosed by the bodies 3, 4 of the connector halves 1, 2. Thus if any arcing or sparking occurs as the electrical connection is broken the delay in complete separation of the connector halves allows sufficient time for any such spark to extinguish before it can become exposed to the surrounding atmosphere.

When partially disengaged the axial distance between the male and female ends 13, 14 of the contact pins is designed to conform to safety standard BS EN 60079-7. The bodies of the connector halves are flameproof such that they comply with safety standard BS EN 60079-1.

After separation, both mating ends of the connector halves 1, 2 can be closed by means of a suitable cap (not shown).

The male and female contact holders 9, 10 effectively define male and female portions for mechanical inter-engagement (although in some embodiments it is to be appreciated that the male portion may be received in the female portion without any physical contact). The shroud spigots 25 of the female contact holder 10 are effectively male portions. The annular channel 20 and bores 19 defined by the shroud 16 of the male contact holder 9 and which receive the shroud spigots 25, effectively acts as a female socket in the mechanical sense. However, the axial separation of the ends 13, 14 of the contact pins 12 from the ends of the respective shroud spigots 25 means that the pins 12 are housed within the respective contact holders 9, 10 in the manner of a socket. Thus, both the contact holders 9, 10 can be considered to define sockets in the electrical sense. This means that both sets of contact pins 12 can remain live when the connector halves 1, 2 are separated and still meet safety requirements. FIGS. 16 to 21 illustrate an alternative embodiment in which each connector half has a contact holder 109, 110 that supports nine contact pins 112. Such a connector configuration is suitable, for example, for an Ethernet connection. Components that are common to the embodiment of FIGS. 1 to 15 are given the same reference numeral but increased by 100 and are not described further except insofar as they differ from their counterparts in the preceding embodiment.

The nine contact pins 112 of each contact holder 109, 110 are arranged such that eight 112 of them are angularly spaced around a central pin 112*b*. There are three shroud spigots 125 in the female contact holder 110, one covering the central contact pin 112*b* and the other two arranged to cover groups of four contact pins 112 offset by 180 degrees as shown. In the male contact holder 109 the shroud 116 defines corresponding sockets 119 formed around the corresponding contact pins 112. More particularly, there is a first socket 119*a* arranged around a group of four adjacent contact pins 112, a second identical socket 119*b* offset from the first by 180 degrees disposed around the other four adjacent contact pins 112 and a third socket 119*c* in the form of a bore around the central contact pin 112*b*. The outer edges of the first and second sockets 119*a, b* are defined by undulating surfaces of the contact holder 109, whereas the radially inner edges are defined by curved surface. As in the previous embodiment there in an annular channel 120 defined in a region of the protective shroud 116 which extends between the first end of the contact holder body 111 and the tips of the pin ends 113. In effect the ends of the two outer sockets 119*a*, 119*b* are interconnected so as to form the substantially annular profile of the channel 120 arranged around a central ring 121 disposed on the central axis of the contact holder 109. This is shown most clearly in FIG. 16. The channel 120 extends to a depth that is just short of the tips of the pins 113. The male shroud spigots 125 again extend beyond the female end portions 114 of the contact pins 112 and are recessed on their outer surfaces such that they may be received in the corresponding sockets 119*a, b*, and *c* and accommodate relative rotation of the connector parts. It will be appreciated that numerous modifications to the above described design may be made without departing from the scope of the invention as defined in the appended claims. For example, the groove defined in the outer surface of the spigot may take any suitable form, including for example a simple linear progression or a curved shape rather than the three portions of the specific embodiment described above. Any number of locking members and grooves may be provided. Furthermore, the retractable collar may be replaced by any suitable alternative such as a retractable rod.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A connector for interconnecting or mutually isolating two or more electrical circuits, comprising first and second inter-engageable connector parts, the first part comprising a spigot extending along an axis and at least one first contact for connection to a respective electrical circuit, the second connector part comprising a socket into which the spigot is to be inserted and at least one second contact for connection to a respective electrical circuit, the second part supporting at least one member projecting radially into the socket, the first part defining at least one groove for receipt of the member, a first contact holder of electrically insulating material carrying the at least one first contact and a second contact holder of electrically insulating material carrying the at least one second contact, wherein the first contact holder has a first shroud disposed around the at least one first contact, the first shroud extending axially beyond the at least one first contact, and the second contact holder has a second shroud disposed around the at least one second contact, the second shroud extending axially beyond the at least one second contact, the contact holders being arranged such that when the spigot is received in the socket, the connector parts are moveable between a first axial position in which one of the first and second shrouds is received within the other of the first and second shrouds but the first and second contacts are axially separated and a second axial position in which one of the first and second shrouds is received within the other and the first and second contacts are engaged.

2. The connector according to claim 1 wherein in the first axial position there is a clearance between the first and second shrouds to allow for relative rotation of the connector parts about the axis.

3. The connector according to claim 1 wherein one of the first and second shrouds is in the form of a male shroud spigot that is receivable within a female recess defined by the other of the first and second shrouds.

4. The connector according to claim 3 wherein a first part of the female recess is a channel in which at least a leading end of the male shroud spigot is received when the connector parts are in the first axial position, the channel at least partially circumscribing the axis so as to accommodate relative rotation of the connector parts about the axis.

5. The connector according to claim 4 wherein a second part of the female recess comprises a bore or socket for receipt of the male shroud spigot.

6. The connector according to claim 4 wherein the male shroud spigot has at least one recess on its outer surface to accommodate its receipt in the channel.

7. The connector according to claim 3 wherein the male shroud spigot extends from a main body of one of the first or second contact holders.

8. The connector according to claim 1 wherein there is a plurality of first contacts within the first shroud.

9. The connector according to claim 1 wherein there is a plurality of second contacts, each contact having a second shroud.

10. The connector according to claim 9 wherein at least some of the second shrouds are joined together around two or more second contacts.

11. The connector according to claim 1 wherein the at least one first and second contacts are in the form of electrically conductive pins.

12. The connector according to claim 1 wherein the first contact holder supports male contacts and the second contact holder supports female contacts, the male contacts being received within the female contacts in the second axial position.

13. The connector according to claim 11 wherein the electrically conductive pins of the at least one first contact have a male end portion and the electrically conductive pins of the at least one second contact have a female end portion, the male end portion being received in the female end portion for electrical contact in the second axial position.

* * * * *